United States Patent [19]

Yoshida et al.

[11] Patent Number: 5,061,677

[45] Date of Patent: Oct. 29, 1991

[54] THERMO-SENSITIVE RECORDING LABEL PAPER

[75] Inventors: Mitsuhiro Yoshida; Nobuyuki Nakayama; Yasuhiro Yamanashi; Tosio Huzii, all of Shizuoka, Japan

[73] Assignee: Tomoegawa Paper Co., Ltd., Tokyo, Japan

[21] Appl. No.: 448,140

[22] Filed: Dec. 12, 1989

[30] Foreign Application Priority Data

Dec. 12, 1988 [JP] Japan ..... 63-312084
Apr. 28, 1989 [JP] Japan ..... 63-107421

[51] Int. Cl.[5] ..... B41M 5/40

[52] U.S. Cl. ..... 503/226; 427/152; 503/200

[58] Field of Search ..... 503/200, 207, 226; 427/150-152

[56] References Cited

U.S. PATENT DOCUMENTS 4,370,370 1/1983 Iwata et al. ..... 428/474.4
4,682,191 7/1987 Tamagawa et al. ..... 503/200
4,717,709 1/1988 Suzuki ..... 503/200

FOREIGN PATENT DOCUMENTS 2110339 6/1983 United Kingdom ..... 503/200

OTHER PUBLICATIONS

Riyouzou Okuno, "Heat Sensitive Recording Medium . . . ", Patent Abst. of Japan, Feb. 8, 1983, vol. 7, No. 31 (M-192)[1176].

Hiroaki Okuda, "Two-Color Thermal Recording Material", Patent Abst. of Japan, Nov. 24, 1988, vol. 12, No. 448 (M-768)[3295].

Yukihiro Yuyama, "Heat Sensitive Recording Type Release Paper", Patent Abst. of Japan, Nov. 5, 1982, vol. 6, No. 220 (M-220)[1098].

*Primary Examiner*—Pamela R. Schwartz

*Attorney, Agent, or Firm*—Cushman, Darby & Cushman

[57] ABSTRACT

A thermo-sensitive recording label paper comprising a laminate which comprises (1) a thermo-sensitive color-developing layer containing at least a colorless or lightly colored leuco-dye provided on one surface of a paper support, (2) a protective layer provided on the color-developing layer, and (3) at least one of a back layer and a protective underlayer, said back layer being provided on the other surface of the paper support, and said protective underlayer being provided between said paper support and said color-developing layer;

the laminate having an internal bond strength of 2.5 kg-cm or more according to Tappi UM-403, and the surface of the protective layer of the laminate having a Bekk smoothness of 500 seconds or more according to JIS P8119.

5 Claims, No Drawings

THERMO-SENSITIVE RECORDING LABEL PAPER

FIELD OF THE INVENTION

The present invention relates to a thermo-sensitive recording label paper, more particularly a thermo-sensitive recording label paper superior in die-cutting processability, recording sensitivity, and readability of recorded images.

BACKGROUND OF THE INVENTION

Thermo-sensitive recording media, such as thermal-sensitive recording paper, are disclosed, e.g., in JP-B-45-14035, which comprise a thermo-sensitive recording layer containing a colorless or lightly colored leuco dye and a color developer for developing color by reaction with the leuco dye upon heating. Such thermo-sensitive recording media are practically used widely. (The term "JP-B" as used herein means an examined Japanese patent publication.)

Thermal printers having thermal heads or the like apparatus are used for recording images on the thermo-sensitive recording media. The thermal recording method using such media is advantageous, in comparison with other conventionally practiced recording methods, in the points of loss noise generation during recording, no needs of development and fixation of images, freedom from maintenance of the apparatus, relatively low cost and compactness of the apparatus, and high sharpness of developed color. Therefore, the thermal recording methods are widely used for recording paper for output recording of computers, facsimiles, electronic calculators, measuring instruments, automatic ticket vending machines and the like.

In recent years, one application field of the thermo-sensitive recording media widely spreading is for labels as the result of increase of POS systems (point-of-sale systems). The thermo-sensitive recording paper for POS systems are mostly used for price indication and bar code indication for perishable foods, and may be brought into contact with water, foodwrapping films containing plasticizers, etc., oils, and the like. Therefore, the thermo-sensitive recording paper for such use is usually provided with a protective layer on the thermo-sensitive color-developing layer in order to prevent the penetration of the above-mentioned foreign matters (e.g., water, plasticizers and oils) into the color-developing layer, and/or with a back layer and/or an underlayer to pravent penetration of the foreign matters from the back face, so as to stabilize the formed images, as shown. e.g., in JP-A-57-188392. (The term "JP-A" as used herein means an unexamined published Japanese patent application.)

The thermo-sensitive recording label paper, as shown in JP-A-U-53-89334 for example, is provided on the back face with a pressure-sensitive adhesive layer which is covered by release paper having been subjected to release treatment. After printing is made, if necessary, on the front surface thereof, it is out into a label form with a die cutting machine having rotary cutters, etc. (The term "JP-A-U" as used herein means an unexamined published Japanese utility model application.)

Recently, in the die-cutting process, attempts are made to increase the cutting speed of label paper and to decrease the width of cut residue called a "skeleton" resulting from the cutting for the purpose of improving the yield and productivity. However, such rationalization of the cutting process leads to increase of the mechanical impact force given to the skeleton on cutting, which is liable to cause breakage of the skeleton, and to make difficult the removal of the skelton from the label, thus disadvantageously resulting in low productivity.

As the recording property among the characteristics required for the labels, high concentration of developed color with low energy consumption, namely high sensitivity, has come to be desired because of the trend of compacting and energy-saving of the recording apparatuses such as bar code printers. The further sensitization is of supreme difficulty because, as being evident from the layer structure of the aforementioned thermo-sensitive recording label paper, the protective layer on the thermo-sensitive color developing layer impairs the efficiency of heat conduction.

For improvement of the sensitivity, various proposals have been submitted regarding the leuco dyes, and color developers used in the thermo-sensitive color developing layer as well as sensitizing agents. Since the decline of the heat conduction efficiency cannot be avoided, it is more important to utilize most effectively the thermal energy given by a thermal head, or in other words, to improve the contact between the thermal head and the surface of the thermo-sensitive recording label paper.

Regarding the improvement of the above-mentioned contact between the thermal head and the recording paper, JP-B-52-20142, for example, describes a method of treating the surface of thermo-sensitive recording paper with a super-calender to attain a Bekk smoothness of the recording paper of from 200 to 1,000 seconds. JP-A-61-179786 describes the use of a support containing a pigment in an amount of 10 wt % or more and having an internal bond strength of from 0.5 to 2.5 kg-cm measured according to Tappi RC-308 to improve the contact with the thermal head. That is, it proposes a method for increasing the flexibility by using a support having a weak internal bonding force and by making closer the contact with the thermal head to improve the recording sensitivity. The above proposals, however, concerns with a thermo-sensitive recording medium being constituted only of a support and a thermo-sensitive color-developing layer provided thereon, but does not concern with thermo-sensitive recording mediums having a protective layer provided on the color-developing layer.

As mentioned above, in recent years, the thermo-sensitive recording label paper is urgently demanded to satisfy simultaneously two requirements of higher processability and higher recording property. Nevertheless, no investigation has been made regarding the mechanical characteristics in die-cutting nor improvement of recording sensitivity in a thermo-sensitive recording label form. Accordingly, no thermo-sensitive recording label paper has been developed which simultaneously satisfies the requirements of the processing characteristics and the recording characteristics.

SUMMARY OF THE INVENTION

An object of the present invention is to provide a thermo-sensitive recording label paper which does not cause troubles in removing skeleton from the cut label in die-cutting operation, or in other words, is superior in processing characteristics without breaking the skeleton, and simultaneously has high thermal sensitivity upon thermal recording.

Another object of the present invention is to provide a thermo-sensitive recording label paper which is superior in processing characteristics without causing breakage of the skeleton, and simultaneously has high thermal sensitivity upon thermal recording, and also has high opacity so that no error tends to occur upon reading.

Other objects and effects of the present invention will be apparent from the following description.

According to an aspect of the present invention, there is provided a thermo-sensitive recording label paper comprising a laminate which comprises (1) a thermo-sensitive color-developing layer containing at least a colorless or lightly colored leuco dye provided on one surface of a paper support, (2) a protective layer provided on the color-developing layer, and (3) at least one of a back layer and a protective underlayer, said back layer being provided on the other surface of the paper support, and said protective underlayer being provided between said paper support and said color-developing layer; the laminate having an internal bond strength of 2.5 kg-cm or more according to Tappi UM-403, and the surface of the protective layer of the laminate having a Bekk smoothness of 500 seconds or more according to JIS P8119.

DETAILED DESCRIPTION OF THE INVENTION

The thermo-sensitive recording label paper of the present invention has a Bekk smoothness of the protective layer surface of 500 seconds or mores, preferably from 500 to 1,500 seconds, and more preferably from 700 to 1,500 seconds, according to JIS P8119.

The inventors of the present invention investigated comprehensively on thermo-sensitive recording label paper in which die-cutting property and recording characteristics are not detoriorated and which does not cause read errors due to lowered opacity, and have finally found that the opacity required for ordinary bar code label paper (used, e.g., for POS systems) having a thickness of from 65 to 80 μm for avoiding read error is preferably at least 80%, more preferably at least 83%, in terms of the opacity according to JIS P8138. It has been also found that it is more preferred, at this time, the protective layer has a Black smoothness of from 500 to 1,500 seconds according to JIS P8119. The inventors investigated comprehensively the measures therefor, and have come to the conclusion that the constitution is effective in which an underlayer containing at least styrene-acryl copolymer fine particles and a binder is provided on a surface of a paper support, and further on the surface thereof a thermo-sensitive color-developing layer containing a colorless or lightly colored leuco dye and a developer, and a protective layer are provided successively, and a back layer is provided on the other surface of the paper support. What is, it is preferred, in the present invention, that the laminate constituting the label paper comprises both the back layer and the underlayer. Alternatively, an opacity of at least 80% may be attained only by one of the back layer and the underlayer.

The internal bond strength, which is a requirement of the present invention, is explained below.

Conventionally, the mechanical properties of thermo-sensitive recording label paper that relates to breaking phenomena of a skeleton upon die-cutting have been considered to be tensile strength (JIS P8113) and tearing strength (JIS P8116) usually tested in paper industry. However, as the results of the comprehensive investigation by the inventors of the present invention regarding the more frequent occurrence of defective cutting accompanied by recent higher cutting speed and smaller skeleton width, the inventors have found that the skeleton breakage is caused principally by low internal bond strength of the thermo-sensitive recording label but not relating to conventionally considered mechanical properties such as tensile strength and tearing strength. This means that the breaking phenomena is not principally correlates with the tensile strength in longitudinal and lateral directions, but the phenomena has to be understood as a mechanical behavior caused by impact force imparted to the label paper in the thickness direction upon die-cutting. The breaking is analyzed that cracking is formed between layers of skeleton by impact force in the thickness direction caused by separating the skeleton from the release paper immediately after the die-cutting, and that the breaking is induced by concentration of the tensile stress generated by winding the skeleton. Thus, the inventors of the present invention has elucidated the internal bond strength of the thermo-sensitive recording label paper to be an important mechanical property for improving the cutting characteristics thereof.

The internal bond strength can be evaluated most effectively with an internal bond tester described in Tappi UM-403. It is found that the internal bond strength of a laminate constituting the thermo-sensitive recording label paper needs to be 2.5 kg-cm or more, preferably from 3 to 5 kg-cm, in order to practicing the die-cutting without trouble irrespective to the cutting speed and the skeleton width.

For achieving the internal bond strength of 2.5 kg-cm of more, firstly the paper for the support is necessary to have an internal bond strength of not less than 2.5 kg-cm. Further, since the cohesive breaking strength of the coat layer itself and the adhesive strength between the coat layer and the support also relates to the internal bond strength, the thermo-sensitive recording label paper is necessary to have an internal bond strength of 2.5 kg-cm or more.

The paper employed as the support in the present invention is not particularly limited by the kind and blending ratio of pulp, and the additives. The paper used therefor can be manufactured by conventional methods while suitably selecting the kind and the blending ratio of pulp, beating condition, kind and amount of the strengthening agent, wet press conditions, drying conditions, etc. so as to have an internal bond strength of 2.5 kg-cm or more.

The thickness of the paper support is preferably from 40 to 100 μm.

The internal bond strength of the coat layer itself and the adhesive strength thereof with the support is controlled by suitably selecting the kind and the amount of the binder as mentioned below to give a desired internal bond strength of the intended label paper.

The Bekk smoothness, which is another requirement of the present invention, is explained below.

In the present invention, as mentioned above, the use of paper support having a internal bond strength of 2.5 kg-cm or more is an essential requirement. The use of such a support, however, will result in a lack of flexibility of the recording paper, which causes poor matching with a thermal head and deterioration of the recording characteristics, as shown in JP-A-61-179786.

As the result of comprehensive investigation on the deterioration of the recording characteristics in the present invention, the recording characteristics is found to become satisfactory for a thermo-sensitive recording label paper having an internal bond strength of 2.5 kg-cm or more if the surface of the protective layer is treated to have a Bekk smoothness of 500 seconds or more, preferably in the range of from 500 to 1,500 seconds, more preferably from 700 to 1,500 seconds, and particularly preferably from 1,000 to 1,500 seconds.

Such thermo-sensitive recording label paper having a Bekk smoothness of the above ranges can be produced by treating the paper to pass through such as a supercalender, a machine calender, and a gloss calender in such a manner that the surface of the protective layer contacts with a metal nip roll. At this time, it is important to select the treating conditions such as moisture content of the paper, pressure of the roll, treating temperature, treating speed, etc. because the paper needs to be treated more severely in comparison with the smoothing treatment of ordinary thermo-sensitive recording paper.

Regarding the moisture content of paper of the above-mentioned treating conditions, for example, the thermo-sensitive recording label paper before the smoothing treatment preferably has a moisture content in the range of from 7 to 10 wt %, whereby the smoothing treatment can easily be conducted. If the moisture content is less than 7 wt %, an extremely high nip pressure, or plural times of the nip treatment is required, thus somewhat lowering the productivity. On the other hand, if the moisture content is more than 10 wt %, the coat layers may be transferred onto the nip roll to stain the roll, or the protective layer may adhere onto the back face in a wound state, namely causing a blocking phenomena, and may undesirably cause trouble in production.

The moisture content can be adjusted by controlling the drying conditions in coating process, or passing the material through a moisture controller before the smoothing treatment.

The Bekk smoothness and the opacity of the thermo-sensitive recording label paper are explained below.

As mentioned above, the opacity of the laminate constituting the thermo-sensitive recording label paper is preferably not less than 80%, more preferably not less than 83%, in order to avoid read errors. In order to attain an opacity of not less than 80%, fillers such as $TiO_2$ are conventionally added to the paper. However, such addition of fillers to the paper often brings decrease in the internal bond strength of the paper. For this purpose in the present invention, it is therefore preferable to provide an underlayer which contains fine particules of a styrene-acryl copolymer. The underlayer serves as a sizing material in coating an aqueous coating composition for the thermo-sensitive color-developing layer, thus preventing a loss of the color-developing component by penetration into a paper support and also smoothing the unevenness on the paper surface due to paper fibers. Accordingly, the advantages are attained by that sufficient recording sensitivity is obtained with lower smoothing pressure and resulting a Bekk smoothness of 500 seconds or more after coating of the protective layer and, as the result of lowering the pressure, the decrease of void ratio is small and the decrease of the opacity is also small.

The fine particles of the styrene-acryl copolymer employed in the present invention preferably has an average particle size of not more than 10 μm, and more preferably not more than 5 μm. The copolymer is not particularly limited and may be a copolymer of styrene with acrylic acid, methacrylic acid, esters thereof, and derivatives thereof. Among the fine particles of the styrene-acryl type copolymer, hollow spherical particles, and/or porous spherical particles having irregular projections are more preferable for the present invention because such shape of particles provide high opacity by their function of light scattering. Further, the fine particles of the styrene-acryl copolymer, which appropriately have hydrophobic and hydrophilic properties, has favorable effects of excellent adhesion to the thermo-sensitive color-developing layer and no decrease of the internal bond strength.

The underlayer of the present invention may be formed by coating and drying a coating composition containing the styrene-acryl copolymer fine paritcles and a binder on a paper support by conventional coating technique. The binder may be those mentioned below for the color-developing layer. The underlayer can also be formed by size press in the paper production process.

A back layer for protecting the back side of the label paper is provided in the present invention because the underlayer containing the styrene-acryl copolymer fine particles has an affinity to oily component such as plasticizers and food oils, and thus is not effective in preventing the penetration of the above oily materials from the back side into the thermo-sensitive color-developing layer.

By the above constitution, the thermo-sensitive recording label paper of the present invention has satisfactory properties such as high internal bond strength, excellent die-cutting property, superior recording sensitivity, little read error due to opacity of 80% or more, and high storability.

The thermo-sensitive color-developing layer of the thermo-sensitive recording label paper of the present invention contains, as the main constituents, a colorless or lightly colored leuco dye and a color-developer for developing the color of the leuco dye.

Examples of the leuco dyes include Crystal violet lactone, 3-diethylamino-7-chlorofluoran, 3-diethylamino-6-methyl-7-chlorofluoran, 3-cyclohexylamino-6-chlorofluoran, 3-diethylamino-7-dibenzylaminofluoran, 3-pyrrolidino-6-methyl-7-anilinofluoran, 3-piperidino-6-methyl-7-anilinofluoran, 3-cyclohexylmethylamino-6-methyl-7-anilinofluoran, 3-ethylisoamylamino-6-methyl-7-anilinofluoran, 3-diethylamino-7-(o-chloroanilino)fluoran, 3-dibutylamino-7-(o-chloroanilino)fluoran, etc., but the present invention is not limited thereto.

Examples of the color-developes which reacts with the above leuco dyes to develop color include α-naphthol, β-naphthol, 4-t-butylphenol, 4-t-octylphenol, 4-phenylphenol, 2,2-bis(p-hydroxyphenyl)propane, 2,2-bis(p-hydroxyphenyl)butane, 4,4'-cyclohexylidenediphenol, 2,2-bis(2,5-dibromo-4-hydroxyphenyl)propane, 4,4'-isopropylidene-bis(2-t-butylphenol), 2,2'-methylene-bis(4-chlorophenol), 4,4'-sulfonyldiphenol, 4,4'-thiobisphenol, benzoic acid, salicylic acid, gallic acid, and their derivatives, but the present invention is not limited thereto.

In the present invention, a conventional thermally fusible substance may further be added to the color-developing layer, if necessary, to improve the recording sensitivity. The thermally fusible substance may be an organic compound having an appropriate melting point. Examples thereof includes higher fatty acid amides such as stearic amide; animal wax such as beeswax, shellac wax, etc.; vegetable wax such as carnauba wax, etc.; mineral wax such as montan wax, etc.; waxes such as paraffin wax, microcrystalline wax, etc.; higher fatty acids; higher fatty acid esters; aromatic carboxylic acid esters such as dimethyl terephthalate, diphenyl phthalate; alkylnaphthalene derivatives; alkyldiphenyl derivatives; and alkylterphenyl derivatives.

Further, sharpness of the developed color image can be improved by addition of conventional fillers such as an inorganic or organic pigment such as heavy or precipitated calcium carbonate, aluminum hydroxide, titanium oxide, zinc oxide, barium sulfate, talc, clay, satin white, kaolinite, particulate polyolefin, particulate polystyrene, particulate urea-formaldehyde resin, etc.

A surfactant, an anti-foaming agent, an antioxidant, an ultraviolet light absorber, or the like, which are conventionally use, may be added to the color-developing layer if necessary.

The thermo-sensitive color-developing layer is formed on the underlayer or on the paper support by binding the above ingredients with a binder. Examples of the binder include casein, gelatin, polyvinyl alcohol, polyvinylpyrrolidone, starch, modified starch, isobutylene-maleic anhydride resins, diisobutylene-maleic anhydride resins, styrene-maleic anhydride resins, polyacrylamide, modified polyacrylamide, carboxymethyl cellulose, methyl cellulose, hydroxyethyl cellulose; emulsion and latexes of vinyl acetate, acrylic esters, vinyl chloride-vinyl acetate copolymers, styrene-butadiene rubber (SBR), acrylonitrile-butadiene rubber (NBR), etc.; and the mixtures thereof. These binders may also be used for the underlayer of the present invention.

The coating composition for the thermo-sensitive color-developing layer is generally prepared by grinding the above-mentioned leuco dye, the color-developer, and the optionally added thermally fusible substance into a dispersion by means of a wet type dispersion mill. The particle size of the leuco dye, the color-developer, and the thermally fusible substance to be dispersed is generally 5 μm or less, and preferably 3 μm or less. The water as the dispersion medium preferably contains a water-soluble high-molecular substance as a dispersing agent in an amount of from about 0.2 to 10 wt %.

The protective layer, the back layer and the protective underlayer each may comprise a high-molecular binder having sufficient film-forming property, and are provided for preventing the penetration of the foreign matters into the color-developing layer. The high-molecular binder, in principle, may be a water-soluble or water-insoluble resin binder as is used in the thermo-sensitive color-developing layer. For the purpose of preventing the penetration of lipophilic substances such as plasticizers and oila, water soluble resins are preferably. Examples of the water-soluble resin include casein, gelatin, polyvinyl alcohol, polyvinylpyrrolidone, starch, modified strach, polyacrylamide, modified polyacrylamide, etc. Among these, polyvinyl alcohol is most preferred. The water-soluble resin binders, however, are inferior in water-resistance. Therefore, in the case where water resistance should be imparted, it is preferred to mix an emulsion or a latex of water insoluble resins, or to add a water-resistance imparting agent such as glyoxal, chrome alum, a melamine resin, a melamine-formaldehyde resin, a polyamide resin, a polyamide-epichlorohydrine resin, etc. into the water-soluble resin binder. A surfactant and an anti-foaming agent may further be added if necessary.

To the protective layer, if necessary, an inorganic or organic pigment, a lubricant such as zinc stearate and calcium stearate, and a releasing agent such as fluorine resins, etc. may be added to improve the matching with the thermal head.

Each layer having the composition as above may be formed by coating the coating compositions successively on the surface or the back face of the support according to a known coating process such as air knife coating, roll coating, bar coating, blade coating, etc. and then drying them.

The coating amount of the color-developing layer is preferably from 3 to 10 g/m$^2$. The coating amounts of the protective layer, the protective underlayer and the back layer each is preferably from 2 to 8 g/m$^2$. The coating amount of the underlayer containing the copolymer fine particles is preferably from 2 to 8 g/m$^2$.

The thermo-sensitive recording label paper of the present invention may further comprises an adhesive layer or a sticking layer which may be covered with release paper. The adhesive or sticking layer may be formed by using conventional adhesives such as an emulsion type adhesive.

The present invention will be described in more detail referring to the following examples and comparative examples, but the present invention is not construed as being limited thereto. All "parts" used in Examples and Comparative Examples are based on the weight.

EXAMPLES 1 TO 3 AND COMPARATIVE EXAMPLE 1

80 parts by weight of LBKP and 20 parts by weight of NBKP were beaten to a beating degree of 400 ml (CSF). A sizing agent (rosin sizing agent) and a band (aluminum sulfate) were added thereto, and subsequently a polyacrylamide paper strengthening agent was added in variable amount so as to prepare two kinds of paper support, A and B as shown in Table 1, different in property, by a Fourdrinier paper machine. The basis weight of the paper was measured according to JIS P8124.

TABLE 1

| | Basis weight (g/m$^2$) | Internal bond strength (kg-cm) | Opacity (%) |
|---|---|---|---|
| Paper support A (present invention) | 60.0 | 3.2 | 73.0 |
| Paper support B (comparison) | 59.8 | 1.8 | 78.2 |

Subsequently, the underlayer coating composition having the composition below was prepared, and coated on the surface of the paper supports A and B to a dry coating amount of 3 g/m$^2$, thus forming the underlayer.

| | |
|---|---|
| Dispersion of fine hollow spherical particles of styrene-acryl copolymer (Ropaque OP-84J, made by Rohm and Haas Co., solid content 42.5%): | 20 parts |
| Styrene-butadiene copolymer latex (solid content 50%): | 6 parts |

Dispersions A, B, and C were prepared respectively by dispersing the mixture having the compositions below by a sand mill for providing the thermo-sensitive color-developing layer coating composition.

| | |
|---|---|
| Dispersion A: | |
| 3-Dibutylamino-7-(o-chloroanilino)fluoran: | 30 parts |
| 5%-methyl cellulose aqueous solution: | 50 parts |
| Water: | 20 parts |
| Dispersion B: | |
| 4,4'-thiobis(2-methylphenol): | 30 parts |
| 5%-polyvinyl alcohol aqueous solution: | 50 parts |
| Water: | 20 parts |
| Dispersion C: | |
| Calcium carbonate: | 40 parts |
| 5%-polyvinyl alcohol aqueous solution: | 40 parts |
| Water: | 20 parts |

By using Dispersions A, B, and C, a coating composition having the composition below was prepared for a thermo-sensitive color-developing layer. The thermo-sensitive color-developing layer was formed by coating the coating composition onto the above underlayer in a dry coating amount of 7 g/m$^2$.

| | |
|---|---|
| Dispersion A | 30 parts |
| Dispersion B | 90 parts |
| Dispersion C | 100 parts |
| 10%-polyvinyl alcohol aqueous solution: | 150 parts |

A coating composition having the composition below was prepared for the back layer.

| | |
|---|---|
| 10%-polyvinyl alcohol aqueous solution: | 100 parts |
| Dispersion C | 20 parts |

Further, a coating composition for the protective layer was prepared by combining 100 parts of the above back layer coating composition and a 5 parts of 30%-zinc stearate dispersion (Hydorin z-7-30, may be Chukyo Yushi Co., Ltd.)

The back layer coating composition was coated onto the back side of the paper supports A and B respectively, on which an underlayer and a thermo-sensitive color-developing layer had been formed, to a dry coating amount of 5 g/m$^2$. Then, the protective layer coating composition was coated onto the surface of the thermo-sensitive color-developing layer and dried to a dry coating amount of 4 g/m$^2$.

The thus-coated articles were treated for smoothing with variation of the nip pressure of a supercalender to provide thermo-sensitive recording label paper having different Bekk smoothness of the protective layer of Examples 1 to 3 and Comparative Example 1 as shown in Table 2.

EXAMPLE 4 and 5

The thermo-sensitive recording label paper of Examples 4 and 5 was prepared in the same manner as in Examples 1 to 3 except that the underlayer coating composition employed had the composition below.

| | |
|---|---|
| Dispersion of fine porous spherical particles of styrene-acryl copolymer having irregular projections (XMRP-110, made by Mitui Toatu Chemicals, Inc., solid content: 46%): | 20 parts |
| Styrene-butadiene copolymer latex (solid content: 50%): | 6 parts |

EXAMPLE 6 AND COMPARATIVE EXAMPLE 2

The thermo-sensitive recording label paper of Example 6 and Comparative Example 2 was prepared in the same manner as in Examples 1 and 2 except that the underlayer was eliminated.

EXAMPLE 7 AND COMPARATIVE EXAMPLE 3

The thermo-sensitive recording label paper of Example 7 and Comparative Example 3 was prepared in the same manner as in Example 1 and 2 except that the underlayer coating composition has the composition below.

| | |
|---|---|
| Dispersion C | 20 parts |
| Styrene-butadiene latex (solid content: 50%): | 6 parts |

On the thermo-sensitive recording label paper prepared in Examples 1 to 7 and Comparative Examples 1 to 3, printing was conducted with a thermal printer made by Matsushita Electronic Parts Co., Ltd. at a power of 0.5 W/dot and a pulse width of 1.0 msec. The recording sensitivity was evaluated by measuring the printing density with a Macbeth reflection densitometer RD-914.

Separately, an emulsion type adhesive layer and release paper were laminated to the thermo-sensitive recording label paper prepared in Examples 1 to 7 and Comparative Examples 1 to 3 to impart a tacking force of the tack number 4 defined by JIS Z0237. The thus-laminated articles were subjected to die-cutting test at a cutting speed of 70 m/min with a skeleton width of 3 mm.

On the thermo-sensitive recording label paper which had been die-cut, bar cords were printed by means of a bar code printer (Code Printer 423 made by Antonson Abery Co.). The printed paper was applied on black paper, and tested for occurrence ratio of read errors (number of read errors per 100 times) with a bar code reader (Codascan 3600 made by RJS Enterprises Inc.).

Table 2 shows the result of the physical properties, recording densities, and the practical characteristics of the thermo-sensitive recording label paper of Examples 1 to 7 and Comparative Examples 1 to 3.

TABLE 2

| | Paper support | Internal bond strength (kg-cm) | Bekk smoothness (sec) | Opacity (%) | Recording density | Die-cutting property | Read error rate |
|---|---|---|---|---|---|---|---|
| Example 1 | A | 3.5 | 600 | 84.5 | 1.33 | good | 0 |
| Example 2 | A | 3.5 | 1,200 | 81.3 | 1.34 | good | 0 |
| Example 3 | A | 3.5 | 2,000 | 79.2 | 1.34 | good | 8 |

TABLE 2-continued

| | Paper support | Internal bond strength (kg-cm) | Bekk smooth-ness (sec) | Opacity (%) | Record-ing density | Die-cutting property | Read error rate |
|---|---|---|---|---|---|---|---|
| Comparative Example 1 | B | 1.9 | 1,300 | 86.2 | 1.34 | poor | * |
| Example 4 | A | 3.8 | 500 | 83.8 | 1.33 | good | 0 |
| Example 5 | A | 3.7 | 1,300 | 80.5 | 1.34 | good | 0 |
| Example 6 | A | 3.6 | 1,400 | 78.0 | 1.32 | good | 15 |
| Comparative Example 2 | A | 3.6 | 400 | 80.1 | 1.25 | good | 0 |
| Example 7 | A | 3.3 | 1,200 | 79.8 | 1.31 | good | 5 |
| Comparative Example 3 | A | 3.3 | 400 | 81.2 | 1.24 | good | 0 |

The symbol "*" means that the bar code printing did not conducted because the label preparation was impracticable.

From the results in Table 2, the thermo-sensitive recording label paper of the present invention is understood to be superior in die-cutting characteristics and recording density. Further, if the opacity is not less than 80%, the label paper of the prsent invention is superior in bar code read characteristics.

EXAMPLES 11 TO 14, AND COMPARATIVE EXAMPLES 11 TO 18

Four kinds of paper supports C to F having different properties shown in Table 3 were prepared from 80 parts of LBKP and 20 parts of NBKP by beating with a beater to varied degree, varying the kind and the amount of a sizing agent, a band and a paper strengthening agent, and treating with a Fourdrinier paper machine. The basis weight, the tensile strength, and the tearing strength were measured according to JIS P8124, JIS P8113, and JIS P8116, respectively.

TABLE 3

| | Basis weight ($g/m^2$) | Internal bond strength (kg-cm) | Tensile strength (kg/15 mm) | | Tearing strength (g/16 sheets) | |
|---|---|---|---|---|---|---|
| | | | longitu-dinal | lateral | longitu-dinal | lateral |
| Paper support C (present invention) | 59.8 | 3.5 | 5.2 | 2.8 | 36.0 | 40.0 |
| Paper support D (present invention) | 60.0 | 2.6 | 6.6 | 4.8 | 39.0 | 46.3 |
| Paper support E (Comparison) | 60.4 | 2.0 | 6.4 | 4.3 | 48.0 | 50.2 |
| Paper support F (Comparison) | 59.6 | 1.5 | 7.0 | 4.0 | 46.5 | 51.5 |

A thermo-sensitive color-developing layer coating composition having the compositions below was prepared by employing the Dispersions A, B and C prepared in Example 1.

| | |
|---|---|
| Dispersion A | 30 parts |
| Dispersion B | 90 parts |
| Dispersion C | 100 parts |
| 10%-polyvinyl alcohol aqueous solution: | 150 parts |

A coating composition having the composition below was prepared for the protective underlayer and the back layer.

| | |
|---|---|
| 10%-polyvinyl alcohol aqueous solution: | 100 parts |
| Dispersion C | 20 parts |

Further, a coating composition for the protective layer was prepared by combining 100 parts by weight of the above coating composition for the protective underlayer and the back layer and 5 parts by weight of 30%-zinc stearate dispersion (Hydrin Z-7-30, made by Chukyo Yushi Co., Ltd.).

The back layer coating composition was coated onto the back side of the paper supports C to F respectively and dried to a dry coating amount of 5 $g/m^2$. Onto the front side of the paper support, the thermo-sensitive color-developing layer coating composition and the protecting layer coating composition were successively coated and dried to dry coating amounts of 7 $g/m^2$ and 4 $g/m^2$, respectively. The thus-coated articles were conditioned to have a moisture content of from 5 to 12 wt % and then subjected to smoothing treatment with a supercalender with the protective layer surface brought into contact with the metal roll. Thus, the thermo-sensitive recording label paper of Examples 11 and 12, and Comparative Example 11 to 14 was prepared.

Separately, on the front surfaces of the paper supports C to F, a protective underlayer coating composition, thermo-sensitive color-developing layer coating composition, and a protective layer coating composition were coated successively to dry coating amounts of 3 $g/m^2$, 7 $g/m^2$, and 4 $g/m^2$, respectively. The thus-coated articles are conditioned to have a moisture content of from 4 to 11 wt % and then subjected to smoothing treatment as above, thus preparing the thermo-sensitive recording label paper of Examples 13 and 14, and Comparative Example 15 to 18.

On the thermo-sensitive recording label paper prepared in Examples 11 to 14 and Comparative Examples 11 to 18, printing was conducted with a thermal printer made by Matsushita Electronic Parts Co., Ltd. at a power of 0.5 W/dot and a pulse width of 1.0 msec. The recording sensitivity was evaluated by measuring the printing density with a Macbeth reflection densitometer RD-914.

Separately, an emulsion type adhesive layer and release paper were laminated to the thermo-sensitive recording label paper prepared in Examples 11 to 14 and Comparative Examples 11 to 18 to have a tacking force of the tack number 4 defined by JIS Z0237. The thus-laminated articles were subjected to die-cutting test at a cutting speed of 70 m/min with a skeleton width of 3 mm.

Table 4 shows the results. In Comparative examples 14 and 18, the Bekk smoothness and the internal bond strength could not be evaluated since the coating material stained the roll at the super calender treatment, and blocking occurred at the winding. In the evaluation of die-cutting property in Table 4, the specimen was evaluated as being "poor" when it could not be cut because of breakage of skeleton at the die-cutting process.

TABLE 4

| | Paper support | Moisture (%) | Bekk smoothness (sec) | Internal bond strength (kg-cm) | Recording density | Die-cutting property |
|---|---|---|---|---|---|---|
| Example 11 | C | 10 | 800 | 3.4 | 1.32 | good |
| Example 12 | D | 8 | 1,200 | 2.6 | 1.34 | good |
| Comparative Example 11 | E | 8 | 1,400 | 2.1 | 1.35 | poor |
| Comparative Example 12 | F | 10 | 1,500 | 1.4 | 1.35 | poor |
| Comparative Example 13 | C | 5 | 400 | 3.5 | 1.20 | good |
| Comparative Example 14 | C | 12 | — | — | — | — |
| Example 13 | C | 7 | 700 | 3.5 | 1.31 | good |
| Example 14 | D | 7 | 1,100 | 2.7 | 1.34 | good |
| Comparative Example 15 | E | 7 | 1,300 | 2.0 | 1.35 | poor |
| Comparative Example 16 | F | 7 | 1,500 | 1.6 | 1.35 | poor |
| Comparative Example 17 | D | 4 | 450 | 2.8 | 1.21 | good |
| Comparative Example 18 | D | 11 | — | — | — | — |

As understood from Table 4, the thermo-sensitive recording label paper of the present invention has both a superior die-cutting characteristics and an excellent recording characteristics.

The thermo-sensitive recording label paper of the present invention is of an unpreceedent excellent quality because it has excellent processing characteristics and recording characteristics. Further, when the opacity of the label paper is not less than 80%, it also has excellent read characteristics.

While the invention has been described in detail and with reference to specific examples thereof, it will be apparent to one skilled in the art that various changes and modifications can be made therein without departing from the spirit and scope thereof.

What is claimed is:

1. A thermo-sensitive recording label paper comprising a laminate which comprises:

(1) a paper support;

(2) a thermo-sensitive color forming layer coated on one surface of said support, said color forming layer comprising:

(a) a colorless or lightly colored leuco dye; and (b) a color developer for developing the color of the leuco dye;

(3) a protective layer, provided on said color forming layer; and (4) at least one layer selected from a back layer and a protective underlayer, said back layer being provided on a surface of said paper support opposite to the surface having the color forming layer coated thereon, and said protective underlayer being provided between said paper support and said color developing layer;

wherein said laminate has an internal bond strength of 2.5 kg-cm or more as measured by Tappi UM-403, and the surface of said protective layer has a Bekk smoothness of 500 seconds or more as measured by JIS P8119.

2. A thermo-sensitive recording label paper as claimed in claim 1, wherein the surface of said protective layer of said laminate has a Bekk smoothness of from 700 to 1,500 seconds according to JIS P8119.

3. A thermo-sensitive recording label paper as claimed in claim 1, wherein said laminate has an opacity not less than 80% according to JIS P8138, and the surface of said protective layer of said laminate has a Bekk smoothness of from 500 to 1,500 seconds according to JIS P8119.

4. A thermo-sensitive recording label paper as claimed in claim 1, wherein said laminate comprises said back layer and said protective underlayer wherein said protective underlayer comprises styrene-acryl copolymer fine particles and a binder and is located between said color forming layer and said paper support.

5. A thermo-sensitive recording label paper as claimed in claim 4, wherein said styrene-acryl copolymer fine particles in said protective underlayer are in the form of hollow spherical particles and/or porous spherical particles having irregular projections.

* * * * *